US008653451B2

(12) United States Patent
Satoh

(10) Patent No.: US 8,653,451 B2
(45) **Date of Patent: *Feb. 18, 2014**

(54) APPARATUS AND METHOD FOR TIME-OF-FLIGHT MASS SPECTROMETRY

(75) Inventor: Takaya Satoh, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/477,105

(22) Filed: May 22, 2012

(65) Prior Publication Data

US 2012/0298855 A1 Nov. 29, 2012

(30) Foreign Application Priority Data

May 23, 2011 (JP) ..... 2011-114774

(51) Int. Cl.
*H01J 49/40* (2006.01)
*H01J 49/06* (2006.01)

(52) U.S. Cl.
USPC ..... 250/287; 250/282

(58) Field of Classification Search
USPC ..... 250/281, 282, 286, 287
See application file for complete search history.

(56) References Cited

U.S. PATENT DOCUMENTS 5,969,348 A * 10/1999 Franzen ..... 250/282
6,518,568 B1 * 2/2003 Kovtoun et al. ..... 250/287
7,157,701 B2 * 1/2007 Ermer ..... 250/287
8,330,100 B2 * 12/2012 Satoh ..... 250/287
2011/0139973 A1 * 6/2011 Bowdler ..... 250/252.1

FOREIGN PATENT DOCUMENTS

GB 2080021 A 1/1982
JP 2000243345 A 9/2000
JP 200386129 A 3/2003
JP 200612782 A 1/2006
WO 2005001878 A2 1/2005

OTHER PUBLICATIONS

Toyoda et al., "Multi-turn time-of-flight mass spectrometers with electrostatic sectors", Journal of Mass Spectrometry, 2003, pp. 1125-1142, vol. 38.

* cited by examiner

*Primary Examiner* — Robert Kim
*Assistant Examiner* — David E Smith
(74) *Attorney, Agent, or Firm* — The Webb Law Firm

(57) ABSTRACT

A flight-of-time mass spectrometer and method of flight-of-time mass spectrometry. The spectrometer includes a storage portion, a parameter adjusting portion, a parameter setting portion, and a flight time measuring portion. The parameter adjusting portion calculates values of an adjustment parameter correlated with any specified m/z value based on an adjustment table. The parameter setting portion sets the delayed extraction parameters of the ion source based on the values of the adjustment parameters calculated by the parameter adjusting portion.

11 Claims, 11 Drawing Sheets

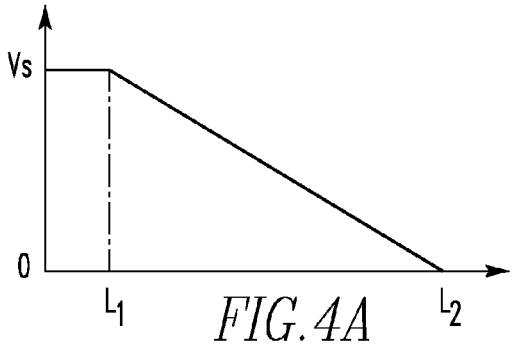
FIG.4A
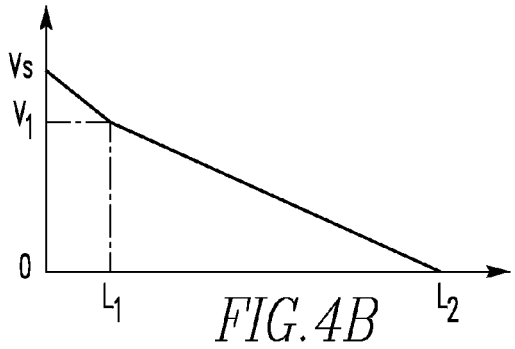
FIG.4B
56
| m/z | DELAYED EXTRACTION PARAMETERS |
|---|---|
| Mb | Pb |
| Ma | Pa |
| Mc | Pc |
FIG.5A
56
| m/z | DELAYED EXTRACTION PARAMETERS |
|---|---|
| Mb | ΔPb |
| Ma | 0 |
| Mc | ΔPc |
FIG.5B

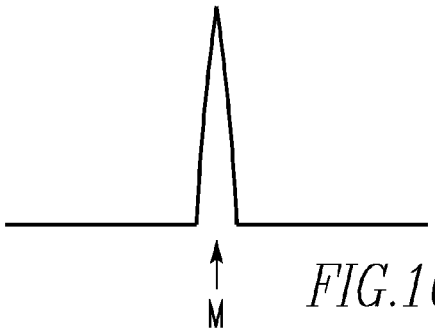
FIG.10A
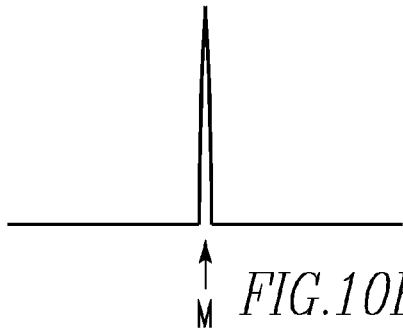
FIG.10B
56
| m/z | ADJUSTMENT PARAMETERS | |
|---|---|---|
| | DELAYED EXTRACTION PARAMETERS | DETECTOR VOLTAGE |
| Mb | Pb | Vb |
| Ma | Pa | Va |
| Mc | Pc | Vc |
FIG.11A
56
| m/z | ADJUSTMENT PARAMETERS | |
|---|---|---|
| | DELAYED EXTRACTION PARAMETERS | DETECTOR VOLTAGE |
| Mb | Pb | ΔVb |
| Ma | Pa | 0 |
| Mc | Pc | ΔVc |
FIG.11B
56
| m/z | ADJUSTMENT PARAMETERS | | |
|---|---|---|---|
| | DELAYED EXTRACTION PARAMETERS | DETECTOR VOLTAGE | m/z CORRECTION AMOUNT |
| Mb | Pb | ΔVb | ΔMb |
| Ma | Pa | 0 | 0 |
| Mc | Pc | ΔVc | ΔMc |
FIG.12

APPARATUS AND METHOD FOR TIME-OF-FLIGHT MASS SPECTROMETRY

BACKGROUND OF THE INVENTION

1. Field of the Invention

The present invention relates to a time-of-flight mass spectrometer and method of time-of-flight mass spectrometry used in quantitative analysis and simultaneous qualitative analysis of trace compounds and also in structural analysis of sample ions.

2. Description of Related Art

A time-of-flight (TOF) mass spectrometer is an instrument that finds the mass-to-charge ratio (m/z) of each ion by accelerating ions with a given accelerating voltage $V_a$, causing them to fly, and calculating the m/z from the time taken for each ion to reach a detector. At this time, from the law of conservation of energy, the following Eq. (1) holds.

$$\frac{mv^2}{2} = zeV_a \tag{1}$$

where v is the velocity of the ion, m is the mass of the ion, z is the valence number of the ion, and e is the elementary charge.

From Eq. (1), the velocity v of the ion is given by $$v = \sqrt{\frac{2zeV_a}{m}} \tag{2}$$

Therefore, the flight time T required for the ion to reach a detector, placed behind at a given distance of L, is given by $$T = \frac{L}{v} = L\sqrt{\frac{m}{2zeV_a}} \tag{3}$$

As can be seen from Eq. (3), ions can be separated according to m/z value by employing the fact that the flight time T differs according to m/z of each ion.

The results obtained by TOF mass spectrometry give a relationship between m/z values converted from the flight time T and the ion intensity at each m/z value. A spectrum in which this relation is represented is known as a mass spectrum. At this time, the work to convert the flight time T into m/z is known as calibration. A formula used for the conversion is known as a calibration formula. Theoretically, the conversion can be made using Eq. (3). In order to obtain higher mass accuracy, polynomial expressions for absorbing systematic errors are often used.

A linear TOF mass spectrometer in which ions are made to fly linearly from an ion source to a detector as shown in FIG. 16A and a reflectron TOF mass spectrometer in which a reflectron field is placed between an ion source and a detector to improve energy focusing and to prolong the flight distance as shown in FIG. 16B have enjoyed wide acceptance.

The mass resolution R of a TOF mass spectrometer is defined as follows:

$$R = \frac{T}{2\Delta T} \tag{4}$$

where T is the total flight time and ΔT is a peak width.

That is, if the peak width ΔT is made constant and the total flight time T can be lengthened, the mass resolution can be improved. However, in the related art linear or reflectron type TOFMS, increasing the total flight time T (i.e., increasing the total flight distance) will lead directly to an increase in instrumental size. A multi-pass time-of-flight mass spectrometer has been developed to realize high mass resolution while avoiding an increase in instrumental size (see M. Toyoda, D. Okumura, M. Ishihara and I. Katakuse, *J. Mass Spectrom.*, 2003, 38, pp. 1125-1142.). This instrument uses four toroidal electric fields each consisting of a combination of a cylindrical electric field and a Matsuda plate. The total flight time T can be lengthened by accomplishing multiple turns in an 8-shaped circulating orbit. In this apparatus, the spatial and temporal spread at the detection surface has been successfully converged up to the first-order term using the initial position, initial angle, and initial kinetic energy.

However, the TOFMS in which ions revolve many times in a closed trajectory suffers from the problem of overtaking. That is, because ions revolve multiple times in a closed trajectory, lighter ions moving at higher speeds overtake heavier ions moving at smaller speeds. Consequently, the fundamental concept of TOFMS that ions arrive at the detection surface in turn first from the lightest one does not hold.

The spiral-trajectory TOFMS has been devised to solve this problem. The spiral-trajectory TOFMS is characterized in that the starting and ending points of a closed trajectory are shifted from the closed trajectory plane in the vertical direction. To achieve this, in one method, ions are made to impinge obliquely from the beginning (see JP-A-2000-243345). In another method, the starting and ending points of the closed trajectory are shifted in the vertical direction using a deflector (see JP-A-2003-86129). In a further method, laminated toroidal electric fields are used (see JP-A-2006-12782).

Another TOFMS has been devised which is based on a similar concept but in which the trajectory of the multi-pass TOF-MS (see GB2080021) where overtaking occurs is zigzagged (see WO2005/001878).

One type of ion source for TOFMS is to ionize a sample by matrix-assisted laser desorption/ionization mass spectrometry (MALDIMS). Mass spectrometry in which MALDI and TOFMS are combined is referred to as MALDI-TOFMS. In a MALDI method, a sample is mixed and dissolved in a matrix of a liquid, crystalline compound, or a powdered metal showing an absorption band for the wavelength of the used laser light. The sample is solidified and irradiated with laser light to vaporize or ionize the sample. In a normal MALDI-TOFMS experiment, plural spots are prepared on a conductive sample plate. A mixture of the sample and the matrix is crystallized at each spot. Often, the sample plate is in the form of a microtiter plate. The user prepares a mixture solution of the sample and the matrix on the sample plate prior to a measurement. Recently, a method consisting of mixing the effluent from a separation means such as a liquid chromatograph with the matrix successively and dripping the mixture onto a sample plate has been used.

In a laser-assisted ionization process typified by MALDI, the initial energy distribution during ion generation is large. To converge the distribution in the direction of flight axis, delayed extraction is used in most cases. In this method, a pulsed voltage is applied after a delay of hundreds of nsec since laser irradiation. The performance of the MALDI-TOFMS has been greatly improved by the adoption of delayed extraction.

However, the delayed ion extraction technique has the disadvantage that the position of the focal point differs slightly according to m/z value. Consequently, if the instrumental conditions are so set that the mass resolution is enhanced at some m/z value, the mass resolution will get worse as it goes away from that m/z value. In order to obtain a high-quality mass spectrum, it is necessary to vary the instrumental conditions using the measured range or an m/z value of interest. Under existing conditions, a work for making adjustments to achieve optimum instrumental conditions based on user's experience is needed. Much labor is necessitated to make such adjustments.

SUMMARY OF THE INVENTION

In view of the above-described problems, the present invention has been made. According to some embodiments of the invention, a TOF mass spectrometer and a method of TOF mass spectrometry can be offered which are capable of producing high-quality mass spectra according to the m/z of any specified ion while alleviating user's labor.

(1) The present invention provides a time-of-flight mass spectrometer having: an ion source for ionizing a sample by laser irradiation and accelerating generated ions by a delayed extraction method; a detector for detecting ions arriving at the detector after making a flight from the ion source; a storage portion holding an adjustment table in which a corresponding relationship between m/z values of known substances and values of given adjustment parameters including delayed extraction parameters associated with the delayed extraction method for the ion source is defined; a parameter adjusting portion for calculating values of the adjustment parameters correlated with any specified m/z value based on the adjustment table; a parameter setting portion for setting the delayed extraction parameters of the ion source based on the values of the adjustment parameters calculated by the parameter adjusting portion; and a flight time measuring portion for measuring flight times taken for the ions generated by the ion source, for which the delayed extraction parameters have been set, to reach the detector.

According to this embodiment of the invention, the values of the adjustment parameters correlated with any specified m/z value are calculated, based on the adjustment table in which the corresponding relationship between the m/z values of known substances and the adjustment parameters including the delayed extraction parameters is defined. The delayed extraction parameters are set. Therefore, for example, if the user specifies an m/z value giving the center of a desired adjustment range, then appropriate delayed extraction parameters corresponding to it are automatically calculated. Consequently, it is not necessary for the user himself to adjust the delayed extraction parameters. Hence, according to the present invention, a high-quality mass spectrum can be obtained according to the m/z value of the specified ion while alleviating the user's burden.

(2) In this TOF mass spectrometer, the delayed extraction parameters may include at least one of a parameter capable of identifying the ratio of a sample plate voltage applied to a sample plate of the ion source to a pulsed voltage applied to accelerating electrodes of the ion source and a parameter capable of identifying timing at which the pulsed voltage is generated.

(3) In this TOF mass spectrometer, the parameter adjusting portion may calculate the values of the adjustment parameters correlated with the specified m/z value by linearly interpolating between the adjustment parameters contained in the adjustment table according to the specified m/z value.

Thus, an adjustment parameter value appropriate for the specified m/z value can be automatically computed.

(4) In this TOF mass spectrometer, the parameter adjusting portion may approximate an expression representing a relationship between the values of the adjustment parameters contained in the adjustment table and the m/z values by a polynomial expression and calculate the values of the adjustment parameters correlated with the specified m/z value using the polynomial expression.

This also makes it possible to automatically calculate adjustment parameters appropriate for the specified m/z value.

(5) In this TOF mass spectrometer, the parameter adjusting portion may set ranges of m/z values in which the values of the adjustment parameters contained in the adjustment table are applied such that the ranges do not overlap with each other and take the values of the adjustment parameters applied in the range of m/z values including the specified m/z value as values of the adjustment parameters correlated with the specified m/z value.

This makes it possible to automatically select an adjustment parameter value appropriate for the specified m/z value while alleviating the computational load.

(6) In this TOF mass spectrometer, the adjustment parameters may include at least one of the intensity of laser light impinging on the ion source and the output voltage from the detector. The parameter setting portion may set at least one of the intensity of the laser light and the output voltage from the detector based on the values of the adjustment parameters calculated by the parameter adjusting portion.

Generally, as the value of the mass-to-charge ratio of an ion is increased, ionization efficiency, ion transmittance, and detection efficiency tend to worsen. The ionization efficiency and ion transmittance can be improved by increasing the laser intensity. Furthermore, the detection sensitivity is improved by increasing the detector voltage. Spectra of uniform quality not affected by ion mass-to-charge ratios can be obtained by including the laser intensity and detector voltage in the adjustment parameters in this way and appropriately adjusting the laser intensity and detector voltage according to the specified m/z value.

(7) This TOF mass spectrometer may further include an m/z calculating portion for converting flight times measured by the flight time measuring portion into m/z values based on a given conversion formula. The adjustment parameters contained in the adjustment table may include correction amounts used to correct the m/z values, which have been converted from the flight times based on the conversion formula, to m/z values of each known substance contained in the adjustment table. The flight times are measured after setting values of the delayed extraction parameters of the known substances into the ion source, the delayed extraction parameters being contained in the adjustment table. The m/z calculating portion may modify coefficients of the conversion formula based on the correction amounts contained in the adjustment table.

If any delayed extraction parameter is varied, the flight time of ions will vary. Therefore, the apparent m/z values of ions would deviate from true values unless the coefficients of the conversion formula for converting flight times into m/z values are varied. Accordingly, the apparent m/z values can be modified to the true m/z values by including the correction amounts used to correct deviations of m/z values for the known substances in the adjustment parameters and varying the coefficients of the conversion formula according to the specified m/z value, based on the correction amounts.

(8) In this TOF mass spectrometer, the parameter adjusting portion may calculate the values of the adjustment parameters correlated with any previously specified m/z value for each spot disposed on the sample plate of the ion source, the spot undergoing a measurement. The parameter setting portion may set the delayed extraction parameters based on the values of the adjustment parameters calculated by the parameter adjusting portion for each spot of the ion source to be measured.

By previously specifying an m/z value giving the center of an adjustment range for each spot to be measured in this way, it is not necessary for the user to make a remeasurement after specifying the m/z value giving the center of the adjustment range according to the results of a measurement of an unknown substance. Accordingly, where a mass range to be measured can be estimated for each spot, automated successive measurements of the spots are enabled. Furthermore, only one measurement is needed for each one spot.

(9) In this TOF mass spectrometer, the parameter adjusting portion may calculate an m/z value corresponding to the strongest intensity based on the output signal from the detector, prompt a user to specify one of the calculated m/z values, and calculate the values of the adjustment parameters.

In this way, a first measurement is performed for each spot to be measured. An adjustment parameter which brings the m/z value corresponding to the strongest intensity into the center of an adjustment range is calculated. Then, a second measurement is performed. Therefore, in a case where the mass range to be measured cannot be estimated for each spot, automated successive measurements of the plural spots can be performed.

(10) In this TOF mass spectrometer, the ion source may ionize the sample by a MALDI technique.

(11) The present invention also provides a method of time-of-flight mass spectrometry, the method starting with ionizing a sample by laser irradiation. Values of given adjustment parameters that are correlated with a specified m/z value are calculated based on an adjustment table in which a corresponding relationship between m/z values of known substances and values of the aforementioned given adjustment parameters is defined. The given adjustment parameters include delayed extraction parameters associated with a delayed extraction method for the ion source that accelerates generated ions by the delayed extraction method. Based on the calculated values of the adjustment parameters, the delayed extraction parameters of the ion source are set. Flight times taken for the ions generated by the ion source, for which the delayed extraction parameters have been set, to reach the detector are measured.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

FIGS. 4A and 4B are graphs showing potential gradients between the sample plate and each accelerating electrode;

FIGS. 5A and 5B show adjustment tables;

FIGS. 10A and 10B are mass spectra obtained respectively before and after a parameter adjustment for an unknown substance;

FIGS. 11A and 11B are adjustment tables according to a second embodiment of the invention;

FIG. 12 is an adjustment table according to a third embodiment of the invention;

DESCRIPTION OF THE PREFERRED EMBODIMENTS

The preferred embodiments of the present invention are hereinafter described in detail with reference with the drawings. It is to be understood that the embodiments described below do not unduly restrict the contents of the present invention set forth in the appended claims and that configurations described below are not always constituent components of the invention.

1. First Embodiment (1) Time-of-Flight (TOF) Mass Spectrometer

Figure 1:
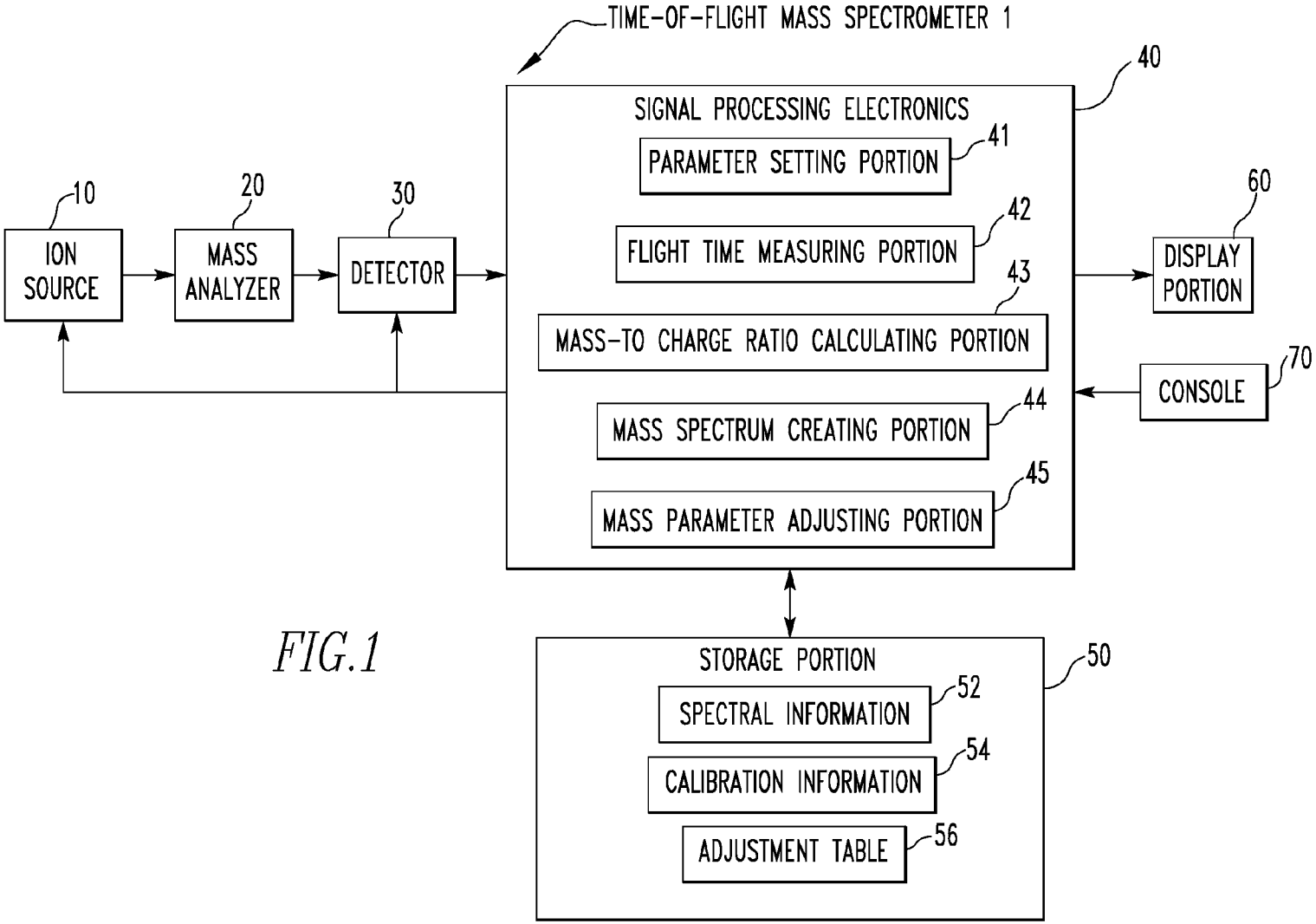
FIG. 1 is a diagram of a time-of-flight (TOF) mass spectrometer according to one embodiment of the present invention, showing the configuration of the spectrometer.

FIG. 1 is a diagram showing the configuration of a MALDI time-of-flight (TOF) mass spectrometer according to the present embodiment. The spectrometer, generally indicated by reference numeral 1, is configured including an ion source 10, a mass analyzer 20, a detector 30, signal processing electronics 40, a storage portion 50, a display portion 60, and a console 70. The TOF mass spectrometer of the present embodiment may omit some of these components.

The ion source 10 ionizes a sample by a given method and accelerates the generated ions toward the detector 30 by producing a certain pulsed voltage. Especially, the ion source 10 of the present embodiment is a MALDI ion source that ionizes the sample by a matrix-assisted laser desorption ionization (MALDI) method. The ion source generates the pulsed voltage with a delay of a given time since laser irradiation by a delayed extraction method.

Figure 2:
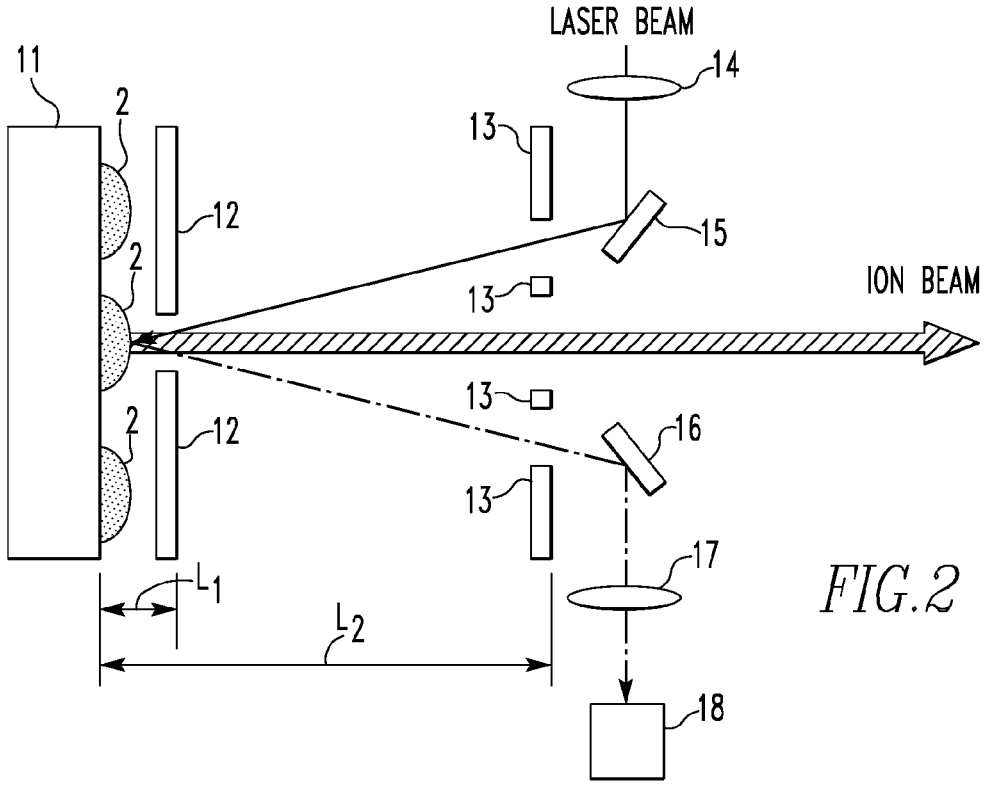
FIG. 2 is an optical ray diagram of the ion source included in the spectrometer shown in FIG. 1.

FIG. 2 schematically shows the configuration of the MALDI ion source 10 of the present embodiment. As shown, the ion source has a sample plate 11. A sample 2 is mixed and dissolved in a matrix (e.g., liquid, crystalline compound, or powdered metal) and solidified. A mass of the sample 2 is placed on each spot of the sample plate 11. Laser light is directed at the mass of sample 2 via a lens 14 and a mirror 15 to vaporize or ionize the sample 2. Accelerating electrodes 12 are placed at a distance of $L_1$ from the sample plate 11. Accelerating electrodes 13 are placed at a distance of $L_2$ from the sample plate 11. Ions generated on each spot of the sample plate 11 are accelerated by voltages impressed on the accelerating electrodes 12 and 13 and guided into the mass analyzer 20 (FIG. 1). A mirror 16, a lens 17, and a CCD camera 18 are disposed to permit one to observe the state of the masses of the sample 2.

Figure 3A:
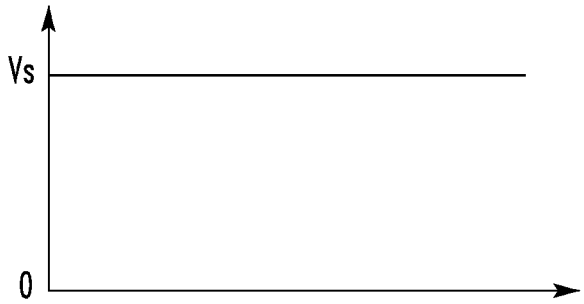
FIG. 3A is a waveform diagram of a voltage applied to the sample plate of the spectrometer shown in FIG. 1.
Figure 3B:
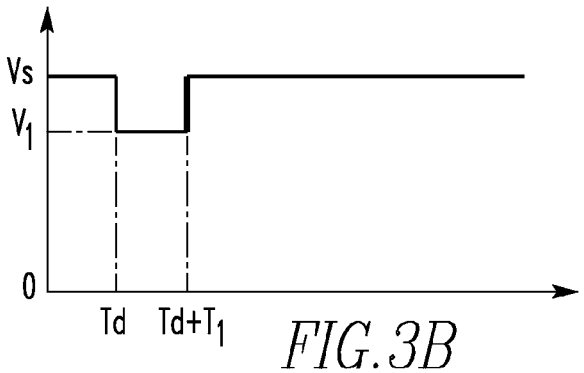
FIG. 3B is a waveform diagram of a voltage applied to the accelerating electrodes of the spectrometer shown in FIG. 1.

FIGS. 3A and 3B show the waveforms of voltages applied to the sample plate 11 and the accelerating electrodes 12 of FIG. 2 to accomplish a measurement of the flight time by a delayed extraction method. In each of FIGS. 3A and 3B, the horizontal axis indicates the elapsed time since the instant at which the signal processing electronics 40 received from the laser a signal indicating laser oscillation. Furthermore, in the present embodiment, the potential at the accelerating electrodes 13 is fixed. In each of FIGS. 3A and 3B, the vertical axis indicates the potentials at the sample plate 11 and accelerating electrodes 12 relative to the potential at the accelerating electrodes 13.

As shown in FIG. 3A, in the present embodiment, the potential at the sample plate 11 is set at a constant value of Vs. On the other hand, as shown in FIG. 3B, the potential at the accelerating electrodes 12 is kept identical with the potential Vs at the sample plate 11 from instant 0 to instant Td but set to potential $V_1$ different from the potential Vs at the sample plate 11 during a given time $T_1$ from instant T. Consequently, a pulsed voltage having a duration of $T_1$ and an amplitude of $|Vs-T_1|$ is generated on the accelerating electrodes 12.

FIG. 4A shows a potential gradient between the sample plate 11 and each accelerating electrode 13 during the interval from the instant 0 to the instant Td. FIG. 4B shows a potential gradient between the sample plate 11 and each accelerating electrode 13 during the interval from the instant Td to the instant $Td+T_1$. In each of FIGS. 4A and 4B, the horizontal axis indicates the distance from the sample plate 11. The vertical axis indicates a potential relative to the potential at the accelerating electrodes 13.

In the present embodiment, as shown in FIG. 4A, the sample plate 11 and accelerating electrodes 12 are at equipotential from the instant 0 to the instant Td, and there is a potential gradient from the accelerating electrodes 12 toward the accelerating electrodes 13. On the other hand, as shown in FIG. 4B, a potential gradient from the sample plate 11 toward the accelerating electrodes 12 occurs and a potential gradient from the accelerating electrodes 12 toward the accelerating electrodes 13 occurs during the interval from the instant Td to the instant $Td+T_1$.

In this way, ions can be accelerated by creating a potential gradient between the sample plate 11 and each accelerating electrode 12 by varying the voltage on the accelerating electrodes 12 at high speed from Vs to $V_1$ after a lapse of a given delay time of Td (e.g., hundreds of nsec) since the signal processing electronics 40 were informed of laser oscillation from the laser. The time at which a measurement of the flight time is started is synchronized with the rising edge of the pulsed voltage.

Referring back to FIG. 1, the mass analyzer 20 separates the ions generated by the ion source 10 according to the flight time T that varies according to mass-to-charge ratio (m/z). In particular, the ions are separated by utilizing the fact that the flight time T varies according to m/z values of ions as given by Eq. (3) above. Where the apparatus is a linear TOF mass spectrometer, the mass analyzer 20 corresponds to the field-free region between the ion source 10 and the detector 30. Where the apparatus is a reflectron TOF mass spectrometer, the mass analyzer 20 corresponds to the region between the ion source 10 including a reflectron field and the detector 30.

The ions separated according to m/z in the mass analyzer 20 reach the detector 30, where the ions are detected. Specifically, the detector 30 produces an output signal corresponding to the amount of impinging ions. The output signal from the detector 30 is fed to the signal processing electronics 40.

The signal processing electronics 40 perform processing necessary for qualitative or quantitative analysis of the ions produced by the ion source 10 according to the output signal from the detector 30. Especially, in the present embodiment, the electronics 40 include a parameter setting portion 41, a flight time measuring portion 42, a mass-to-charge ratio (m/z) calculating portion 43, a mass spectrum creating portion 44, and a mass parameter adjusting portion 45. Each part of the processing electronics 40 may be made of a dedicated circuit. The electronics 40 may be implemented by a microcomputer or the like. The functions of the various parts may be realized by executing programs stored in a storage portion (not shown). Some of the components of the signal processing electronics 40 of the present embodiment may be omitted. Additional components may be added to the electronics 40.

The parameter setting portion 41 performs processing for setting parameters (hereinafter referred to as the instrumental parameters) for the ion source 10, mass analyzer 20, and detector 30. The instrumental parameters include parameters (hereinafter referred to as delayed extraction parameters) associated with delayed extraction for the ion source 10, laser intensity, and output voltage from the detector 30. Furthermore, in the present embodiment, those of the instrumental parameters which are modified in a corresponding manner with the m/z value specified by the user through the console 70 are referred to as adjustment parameters. Especially, in the present embodiment, the delayed extraction parameters are included in the adjustment parameters.

One example of delayed extraction parameter is a parameter capable of identifying the ratio of the voltage (hereinafter referred to as the sample plate voltage) applied to the sample plate to the pulsed voltage applied to the accelerating electrodes 12. Another example of delayed extraction parameter is a parameter capable of identifying the timing at which the pulsed voltage is generated. One example of parameter capable of identifying the ratio of the sample plate voltage to the pulsed voltage is the ratio of the sample plate voltage Vs to the amplitude, $|Vs-V_1|$, of the pulsed voltage or the ratio of Vs to $V_1$. One example of the parameter capable of identifying the timing at which the pulsed voltage is generated is the delay time Td.

The flight time measuring portion 42 measures the flight times taken for ions generated by the ion source 10 to reach the detector 30 from the output signal from the detector 30. The signal processing electronics 40 correlate the measured flight times with the intensity detected by the detector 30 to thereby create spectral information 52, and store the information in the storage portion 50.

The m/z calculating portion 43 converts the flight time T measured by the flight time measuring portion into mass-to-charge ratio (m/z), based on given conversion formula (calibration formula). For example, the calibration formula is given by $$\sqrt{m/z}=a+bT+cT^2 \tag{5}$$

The three coefficients a, b, and c of Eq. (5) are known as calibration coefficients, and can be computed by previously measuring the flight times of ions of three or more known substances having known m/z values. The coefficients are stored as calibration information 54 in the storage portion 50.

The mass spectrum creating portion 44 refers to the spectral information 52, correlates the m/z calculated by the m/z calculating portion 43 and the detected intensity, and creates mass spectral information. The created mass spectral information is routed to the display portion 60. A mass spectrum obtained by plotting m/z values on the horizontal axis and plotting the detected intensity on the vertical axis is displayed on the display portion 60.

The parameter adjusting portion 45 calculates the values of the adjustment parameters correlated with the m/z value specified by the user, based on an adjustment table 56 stored in the storage portion 50.

The corresponding relationship between the m/z values of known substances and the adjustment parameters is defined in the adjustment table 56. In the present embodiment, the delayed extraction parameters are included in the adjustment parameters. In mass spectra obtained by generating ions of given known substances by the ion source 10, delayed extraction parameters which have been so adjusted that the mass resolution near the peak is enhanced are correlated with the m/z values of the known substances. Thus, the adjustment table 56 is created.

FIGS. 5A and 5B are examples of the adjustment table 56. In the example of FIG. 5A, the m/z values Ma, Mb, and Mc for three known substances A, B, and C are correlated with adjusted delayed extraction parameters Pa, Pb, and Pc, respectively. On the other hand, in the example of FIG. 5B, the m/z values Ma, Mb, and Mc for the three known substances A, B, and C are correlated with 0, ΔPb, and ΔPc, respectively, that are relative values of the adjusted delayed extraction parameters relative to the known substance A. In the example of FIG. 5B, if adjusted delayed extraction parameters for the known substances A, B, and C are Pa, Pb, and Pc, respectively, then the parameters Pb and Pc are calculated using Pb=Pa+ΔPb and Pc=Pa+ΔPc.

For example, the parameter adjusting portion 45 may calculate the values of the adjustment parameters correlated with the specified m/z value by linearly interpolating between the values of adjustment parameters contained in the adjustment table 56 according to the specified m/z value.

Figure 6A:
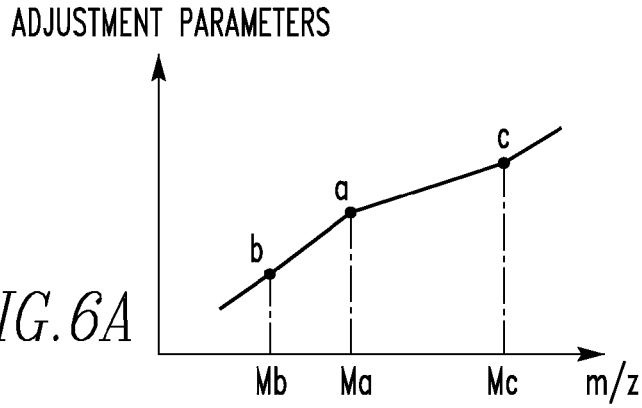
FIGS. 6A, 6B, and 6C are charts illustrating methods of calculating adjustment parameters.

FIG. 6A is a graph obtained by plotting the values of the adjustment parameters calculated in this way. In the graph of FIG. 6A, the horizontal axis indicates m/z values, while the vertical axis indicates the values of adjustment parameters. In the example of FIG. 6A, three points a, b, and c at which the m/z value is Ma, Mb, and Mc, respectively, are plotted in accordance with the adjustment table 56 of FIG. 5A or 5B. The relationship Mb<Ma<Mc holds. Where the specified m/z value satisfies the relationship Mb<M<Ma, an adjustment parameter value for M is computed by linearly interpolating between the points b and a. Where the specified m/z value M satisfies the relationship Ma<M<Mc, an adjustment parameter value for M is computed by linearly interpolating between the points a and c. In this way, an appropriate adjustment parameter value for any specified m/z value can be automatically computed.

Alternatively, the parameter adjusting portion 45 may approximate the expression representing the relationship between the values of the adjustment parameters contained in the adjustment table 56 and m/z values by a polynomial expression and calculate the values of adjustment parameters correlated with the specified m/z value using the polynomial expression.

Figure 6B:
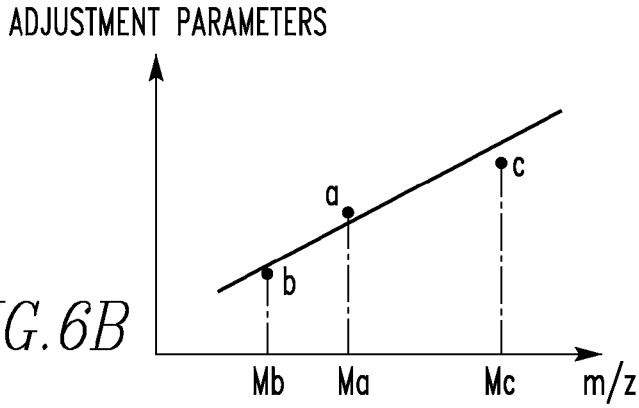

FIG. 6B is a graph obtained by plotting the adjustment parameters calculated in this way. The axes of FIG. 6B are the same as the axes of FIG. 6A. In the example of FIG. 6B, adjustment parameters are approximated from three points a, b, and c using a polynomial expression about m/z values, and adjustment parameter values for M are calculated by substituting the specified m/z value into the polynomial expression. Again, adjustment parameter values appropriate for the specified m/z value can be automatically calculated.

Furthermore, the parameter adjusting portion 45 may set m/z ranges in which adjustment parameter values contained in the adjustment table 56 are applied such that the ranges do not overlap with each other and take the values of adjustment parameters applied in the m/z range containing the specified m/z value as adjustment parameter values correlated with the specified m/z value.

Figure 6C:
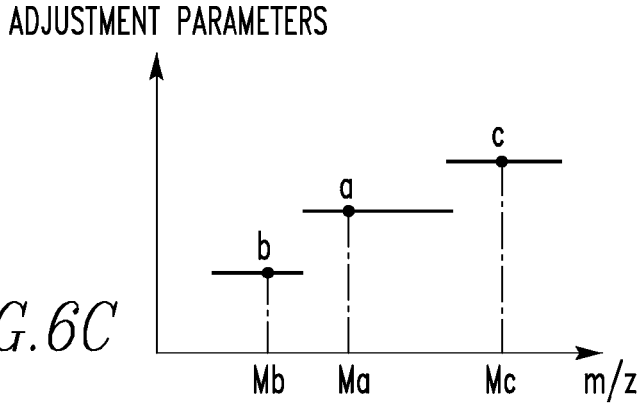

FIG. 6C is a graph obtained by plotting the adjustment parameters calculated in this way. The axes of FIG. 6C are the same as the axes of FIG. 6A. In the example of FIG. 6C, when a specified m/z value of M is contained within a given range containing Mb, Pb is used as an adjustment parameter value for M. When a specified m/z value of M is contained within a given range containing Ma, Pa is used as an adjustment parameter value for M. When a specified m/z value of M is contained within a given range containing Mc, Pc is used as an adjustment parameter value for M. In this way, adjustment parameter values appropriate for the specified m/z value can be automatically selected while alleviating the computational load.

The parameter setting portion 41 resets the delayed extraction parameters of the ion source 10 based on adjustment parameter values calculated by the parameter adjusting portion 45. A mass spectrum is again created by the processing operations performed by the flight time measuring portion 42, m/z calculating portion 43, and mass spectrum creating portion 44. In consequence, a mass spectrum is obtained in which the mass resolution is high near an m/z value specified by the user.

(2) Method of Mass Analysis of Unknown Samples

Figure 7:
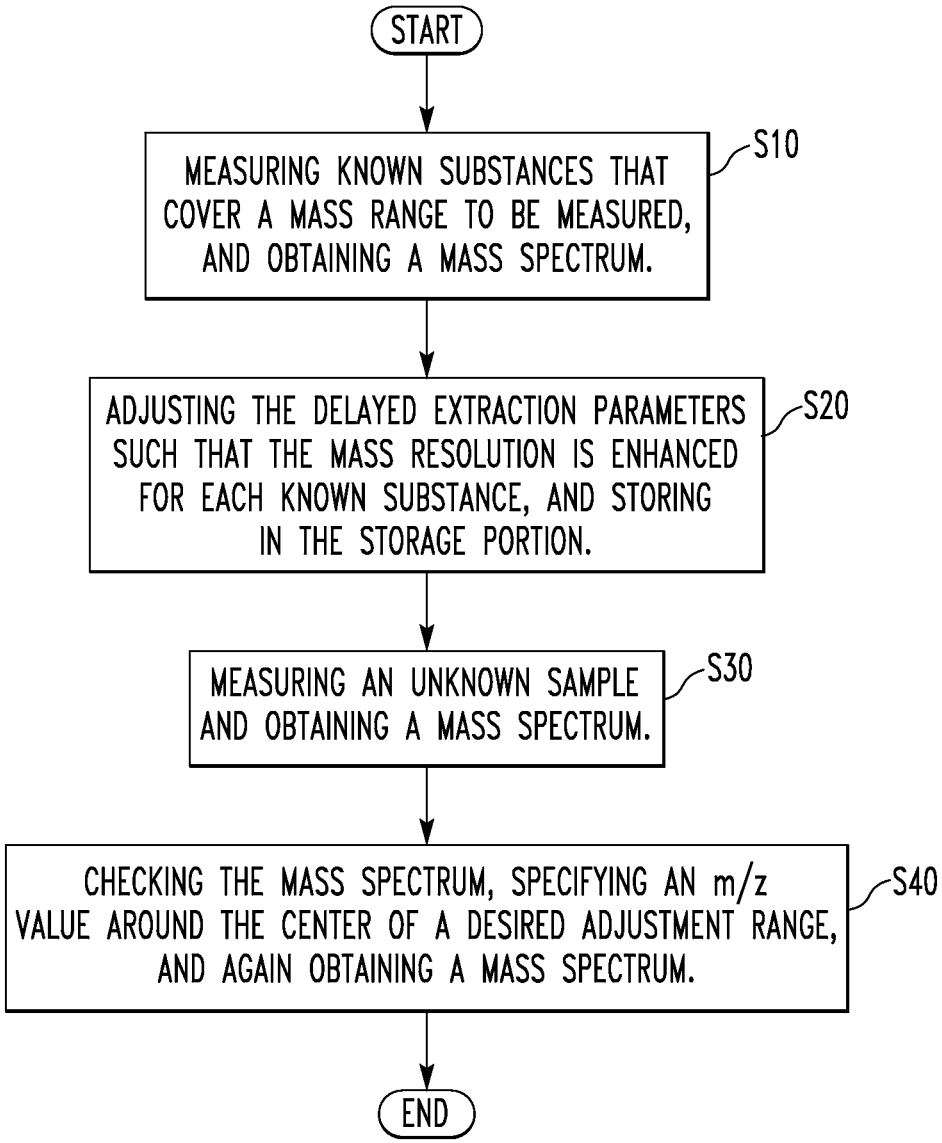
FIG. 7 is a flowchart illustrating one method of mass analyzing an unknown substance.

FIG. 7 is a flowchart illustrating one example of method of mass analyzing unknown samples using the TOF mass spectrometer of the present embodiment.

Figure 8:
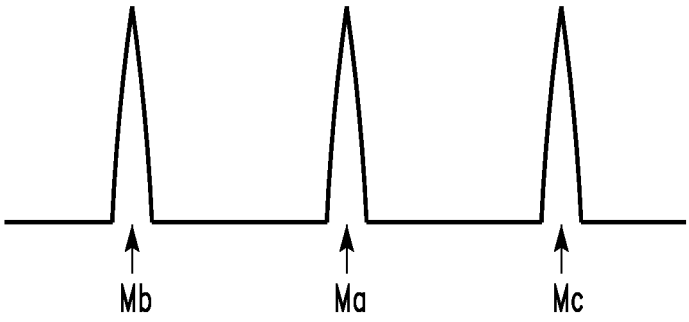
FIG. 8 is a mass spectrum obtained prior to a parameter adjustment for a known substance.

First, the user measures known substances that cover a mass range to be measured, and obtains a mass spectrum (S10). For example, as shown in FIG. 8, three known substances A, B, and C having m/z values of Ma, Mb, and Mc, respectively, are measured, and a mass spectrum having three peaks at Ma, Mb, and Mc is obtained. Since this mass spectrum is obtained while the delayed extraction parameters are kept at initial settings, the mass resolution near the three peaks is not high in many cases.

Figure 9A:
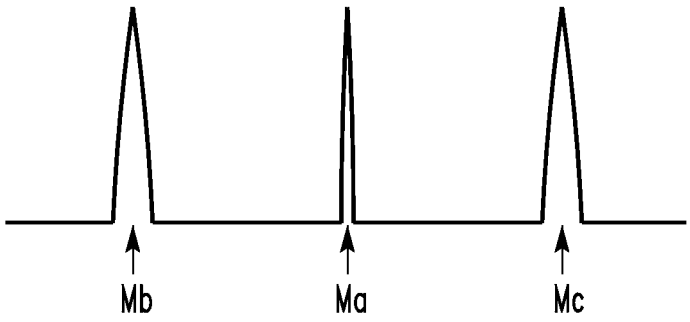
FIGS. 9A, 9B, and 9C are mass spectra obtained after the parameter adjustment for known substances.
Figure 9B:
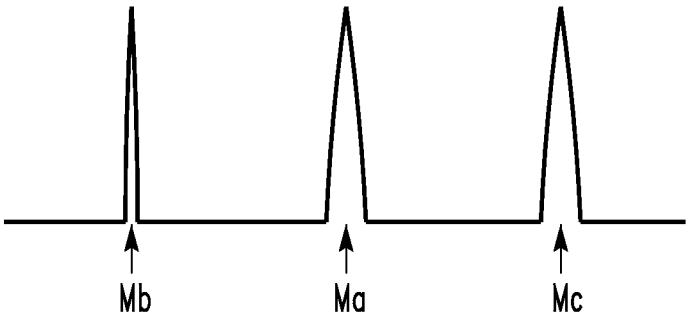
Figure 9C:
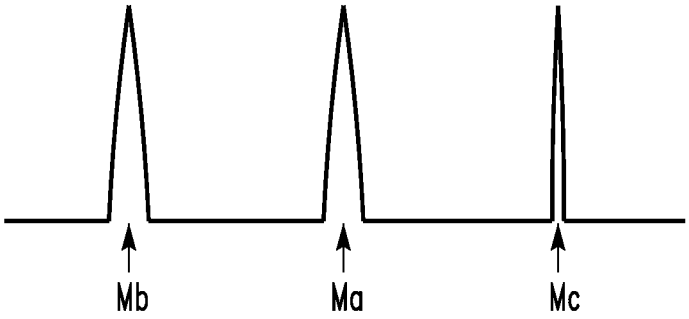

Then, the user adjusts the delayed extraction parameters such that the mass resolution is enhanced for each known substance. The adjustment table 56 is created and stored in the storage portion 50 (S20). For example, the delayed extraction parameters are adjusted to obtain a mass spectrum in which the mass resolution is high around Ma as shown in FIG. 9A. Let Pa be the adjusted delayed extraction parameter. Furthermore, the delayed extraction parameter is adjusted to obtain a mass spectrum in which the mass resolution is high near Mb as shown in FIG. 9B. Let Pb be the adjusted delayed extraction parameter. In addition, the delayed extraction parameter is so adjusted that a mass spectrum in which the mass resolution is high near Mc as shown in FIG. 9C is derived. Let Pc be the adjusted delayed extraction parameter. Ma, Mb and Mc are correlated with Pa, Pb, and Pc, respectively. The adjustment table 56 as shown in FIG. 5A or 5B is created and stored in the storage portion 50.

Then, the user measures an unknown sample and obtains a mass spectrum (S30). For example, a mass spectrum having a peak of m/z value around M is derived as shown in FIG. 10A by measuring an unknown sample. This mass spectrum has been obtained by setting a given delayed extraction parameter (e.g., delayed extraction parameter Pa) into the ion source 10. In many cases, the mass resolution is not high near the peak.

The user then checks the mass spectrum, specifies an m/z value around the center of a desired adjustment range, and again obtains a mass spectrum (S40).

The TOF mass spectrometer 1 of the present embodiment calculates the value of an adjustment parameter, which can be correlated with an m/z value specified by the user, from this m/z value and resets the delayed extraction parameter of the ion source 10. Furthermore, the spectrometer 1 starts to measure an unknown sample and again creates a mass spectrum by the aforementioned processing operations by the various portions.

For example, where a mass spectrum as shown in FIG. 10A is obtained at step S30, if M is specified as an m/z value at step S40, a mass spectrum in which the mass resolution is high near the peak is obtained as shown in FIG. 10B.

According to the TOF mass spectrometer of the first embodiment described so far, the value of an adjustment parameter correlated with an m/z value specified by a user is calculated based on the adjustment table 56 in which a corresponding relationship between m/z values of known substances and values of a delayed extraction parameter is defined. The delayed extraction parameter is reset, and a mass spectrum is again created. For example, if the user specifies an m/z value giving the center of a desired adjustment range, then a corresponding appropriate delayed extraction parameter is automatically computed. This makes it unnecessary for the user himself to adjust the delayed extraction parameter. Hence, according to the TOF mass spectrometer of the first embodiment, a high-quality mass spectrum complying with the specified m/z value can be obtained while alleviating user's labor.

2. Second Embodiment

Generally, as the m/z value of an ion is increased, the ionization efficiency, ion transmittance, and detection efficiency deteriorate. Accordingly, in a TOF mass spectrometer according to the second embodiment, the output voltage from the detector 30 and the intensity of laser light emitted from the ion source 10 are added as adjustment parameters to the adjustment table 56 to obtain a spectrum of uniform quality irrespective of m/z values of ions.

The TOF mass spectrometer of the second embodiment is similar in configuration with the spectrometer of the first embodiment shown in FIG. 1 except for the following points.

FIGS. 11A and 11B show examples of the adjustment table 56 of the second embodiment. In the example of FIG. 11A, voltage values Va, Vb, and Vc that are set into the detector 30 in a corresponding manner to the m/z values of Ma, Mb, and Mc, respectively, are added to the adjustment table 56 of FIG. 5A. On the other hand, in the example of FIG. 11B, relative voltage values of 0, ΔVb, and ΔVc for an unknown substance A that are set into the detector 30 in a corresponding manner to the m/z values of Ma, Mb, and Mc, respectively, are added to the adjustment table 56 of FIG. 5B. In the case of the example of FIG. 11B, let Va, Vb, and Vc be voltage values set into the detector 30 for known substances A, B, and C, respectively. Calculations are performed, using the relationships Vb=Va+ΔVb and Vc=Va+ΔVc.

The parameter adjusting portion 45 calculates the values of adjustment parameters (e.g., delayed extraction parameter, detector voltage, and laser intensity), which are correlated with any specified m/z value, based on the adjustment table 56.

Furthermore, the parameter setting portion 41 resets the delayed extraction parameter and laser intensity into the ion source 10 based on the adjustment parameter value calculated by the parameter adjusting portion 45 and resets voltages into the detector 30.

A measurement of an unknown sample is started. A mass spectrum is again created owing to the above-described processing operations performed by the various portions.

In this way, according to the TOF mass spectrometer of the second embodiment, laser intensity and output voltage of the detector 30 are included in the adjustment parameters. Mass spectra of uniform quality irrespective of m/z value can be obtained by appropriately adjusting the laser intensity and output voltage from the detector 30 according to the specified m/z value.

3. Third Embodiment

If the instrumental conditions such as for the ion source 10 are varied by resetting adjustment parameters, the flight times of ions vary. Therefore, m/z values observed in a mass spectrum vary slightly and deviate from their true values. Consequently, it is necessary to modify the calibration values accordingly. In the TOF mass spectrometer of the third embodiment, therefore, m/z correction values for correcting deviations of the m/z values are previously included in the adjustment parameters of the adjustment table 56.

The TOF mass spectrometer of the third embodiment is similar to the TOF mass spectrometer of the first embodiment of FIG. 1 except for the following points.

In order to create the adjustment table 56, the delayed extraction parameter Pa that has been adjusted so as to enhance the resolution around the m/z value of Ma for the known substance A is first set into the ion source 10. The known substances A, B, and C are measured. The coefficients a, b, and c of the calibration formula (5) are determined from the relationship between the obtained flight times Ta, Tb, and Tc for the known substances A, B, and C, respectively, and the m/z values of Ma, Mb, and Mc.

A mass spectrum is so adjusted that the mass resolution is then enhanced around the peak of the known substance B. The deviation (m/z correction value) ΔMb from the m/z value of Mb at this peak of the spectrum is added to the adjustment table 56.

Similarly, another mass spectrum is so adjusted that the mass resolution is enhanced around the peak of the known substance C. The deviation (m/z correction amount) ΔMc from the m/z value of Mc at this peak of the spectrum is added to the adjustment table 56.

FIG. 12 shows one example of the adjustment table 56 according to the third embodiment. In the example of FIG. 12, correction amounts 0, ΔMb, and ΔMc of m/z values are added to the adjustment table 56 of FIG. 11B in a corresponding manner to the m/z values of Ma, Mb, and Mc, respectively.

When an unknown sample is measured, the delayed extraction parameter Pa is first set into the ion source 10 and a mass spectrum is acquired. Consequently, a mass spectrum having a peak close to the m/z value of M of the unknown sample is obtained as shown in FIG. 10A. This mass spectrum is obtained under the condition where the delayed extraction parameter Pa has been set into the ion source 10. Often, the mass resolution near the peak is not high.

If the user checks this mass spectrum and specifies an m/z value as the center of a desired adjustment range, the parameter adjusting portion 45 adjusts the delayed extraction parameter. The parameter setting portion 41 resets the adjusted delayed extraction parameter into the ion source. The flight time measuring portion 42 again measures the flight time of the unknown sample. Let $T_m$ be this flight time.

This flight time is substituted into the calibration formula (5). Consequently, a conversion is performed from the true m/z value of M about the unknown sample into M+ΔM that deviates from M by ΔM as given by $$\sqrt{M+\Delta M}=a+bT_m+cT_m^2 \quad (6)$$

Accordingly, in the present embodiment, any coefficient of the calibration formula (5) is varied by the m/z calculating portion 43 such that the flight time $T_m$ is converted into the m/z value of M. For example, by changing the calibration coefficient b into b', a new calibration formula as given by Eq. (7) is obtained.

$$\sqrt{M}=a+b'T_m+cT_m^2 \quad (7)$$

Eqs. (6) and (7) lead to $$b'=b+(\sqrt{M}-\sqrt{M+\Delta M})/T_m \quad (8)$$

In Eq. (8), b and $T_m$ are known. Also, M is known, because it is an m/z value specified by the user. Therefore, b' can be computed from Eq. (8) if the m/z correction amount ΔM is calculated.

In the present embodiment, the m/z calculating portion 43 refers to the adjustment table 56 and calculates an m/z correction amount of ΔM for M from m/z correction amounts of 0, ΔMb, and ΔMc for m/z values of Ma, Mb, and Mc, respectively.

That is, in a mass spectrum obtained from the adjustment table 56 by setting the delayed extraction parameter Pa, the m/z correction amount of ΔM used when an m/z value (=M) at the peak of an unknown substance is specified can be estimated and calculated because the m/z correction amount when the m/z value (=Ma) of the peak for the known substance A is specified is 0, the m/z correction amount when the m/z value (=Mb) of the peak for the known substance B is specified is ΔMb, and the m/z correction amount when the m/z value (=Mc) at the peak of the known substance C is specified is ΔMc.

For instance, the m/z calculating portion 43 may calculate the value of the m/z correction amount correlated with an m/z value specified by the user by linearly interpolating between the m/z correction amounts included in the adjustment table 56 according to the m/z value specified by the user such that this specified m/z value gives the center of an adjustment range.

Figure 13A:
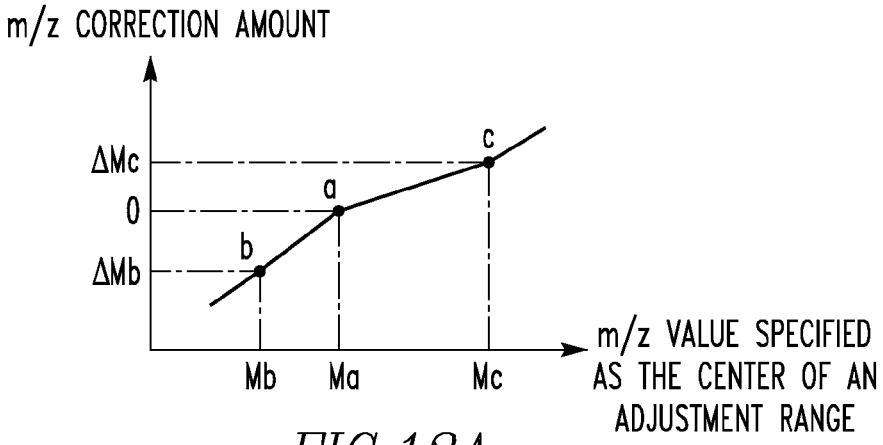
FIGS. 13A, 13B, and 13C are charts illustrating methods of calculating m/z correction amounts.

FIG. 13A is a graph obtained by plotting the m/z correction amounts calculated in this way. In FIG. 13A, the horizontal axis indicates the m/z value specified as the center of an adjustment range. The vertical axis indicates the m/z correction amount. In the example of FIG. 13A, three points a, b, and c are plotted according to the adjustment table 56 of FIG. 12. At the point a, the m/z value is Ma, and the m/z correction amount is 0. At the point b, the m/z value is Mb, and the m/z correction amount is ΔMb. At the point c, the m/z value is Mc, and the m/z correction amount is ΔMc. There is the relationship Mb<Ma<Mc. Where the specified m/z value M meets the relationship Mb<M<Ma, the m/z correction amount of ΔM is calculated by linearly interpolating between the points b and a. Also, where the specified m/z value M meets the relationship Ma<M<Mc, the m/z correction amount ΔM is calculated by linearly interpolating between the points a and c. In this way, an m/z correction amount appropriate for any specified m/z value can be automatically computed.

The m/z calculating portion 43 may approximate the expression representing the relationship between the values of m/z correction amounts contained in the adjustment table 56 and m/z values by a polynomial expression and calculate the value of the m/z correction amount correlated with the m/z value specified by the user using the polynomial expression.

Figure 13B:
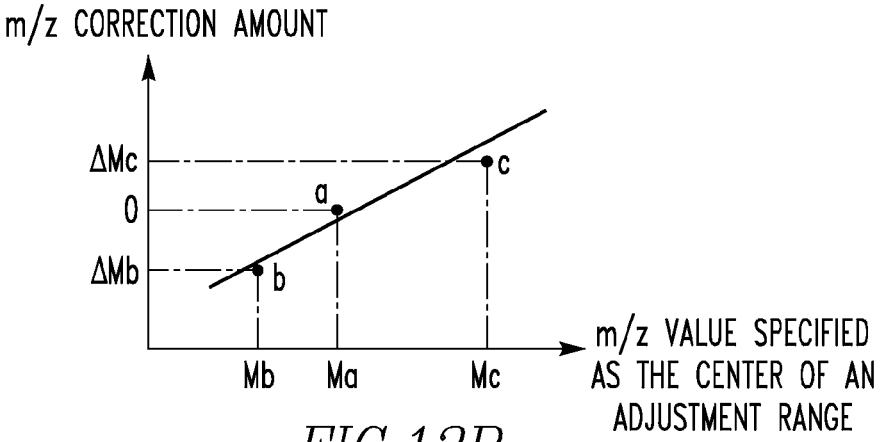

FIG. 13B is a graph obtained by plotting the m/z correction amounts calculated in this way. The axes of FIG. 13B are the same as the axes of FIG. 13A. In the example of FIG. 13B, the m/z correction amount ΔM is computed by approximating the m/z correction amounts by a polynomial expression of m/z values at three points a, b, and c and substituting the specified m/z value M into the polynomial expression. Again, an appropriate m/z correction amount for the specified m/z value can be automatically calculated.

Furthermore, the m/z calculating portion 43 may set m/z ranges in which m/z correction amounts contained in the adjustment table 56 are applied such that the ranges do not overlap with each other and use m/z correction amounts applied in the m/z range containing the m/z value specified by the user as the m/z correction amount correlated with the specified m/z value.

Figure 13C:
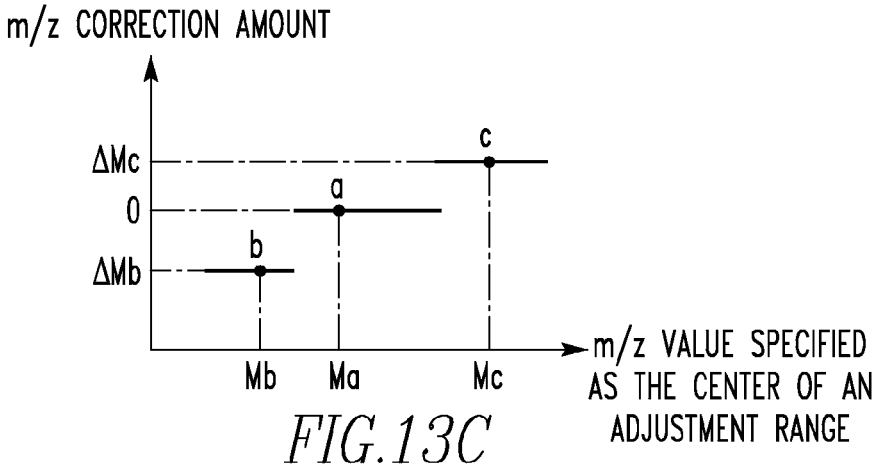

FIG. 13C is a graph obtained by plotting the m/z correction amounts computed in this way. The axes of FIG. 13C are the same as the axes of FIG. 13A. In the example of FIG. 13C, in a case where the specified m/z value M falls within a given range containing Mb, ΔMb is used as the m/z correction amount ΔM. Furthermore, where the specified m/z value M falls within the given range containing Ma, 0 is used as the m/z correction amount ΔM. Where the specified m/z value M is contained in the given range containing Mc, ΔMc is used as the m/z correction amount ΔM. In this way, an m/z correction amount appropriate for the specified m/z value can be automatically selected while alleviating the computational load.

A mass spectrum in which the mass resolution is high near M that is the true m/z value of an unknown sample as shown in FIG. 10B is obtained by calculating a new coefficient b' from Eq. (8) using the m/z correction amount ΔM and by using the new calibration formula (7).

Thus, according to the TOF mass spectrometer of the third embodiment, the m/z value can be modified to the true m/z value by containing an m/z correction amount for a known substance as an adjustment parameter within the adjustment table 56 and modifying the calibration coefficients according to the specified m/z value based on the m/z correction amount.

Especially, where the observed mass differs greatly among individual spots, mass spectra obtained from the spots can be improved in quality. This is effective, for example, where the effluent from a size exclusion chromatograph that is one type of the aforementioned liquid chromatograph is separated into plural spots on the sample plate and measured. Since effluent constituents from the size exclusion chromatograph generally leave the chromatograph first from the constituent having the greatest molecular weight, the molecular weight distribution within one spot (i.e., one aliquot) is limited. However, the molecular weight distribution across the spots is wide. Consequently, it is necessary to modify the adjustment parameters such as the delayed extraction parameters among the spots.

4. Fourth Embodiment

The TOF mass spectrometers of the first through third embodiments once create a mass spectrum, prompt the user to check the spectrum and to specify an m/z value giving the center of a desired adjustment range, and then again create a mass spectrum. In contrast, the TOF mass spectrometer of the fourth embodiment previously specifies an m/z value giving the center of a desired adjustment range and creates a mass spectrum only once.

The TOF mass spectrometer of the fourth embodiment is similar in configuration with the spectrometer of the first embodiment shown in FIG. 1 except for the following points.

Figure 14:
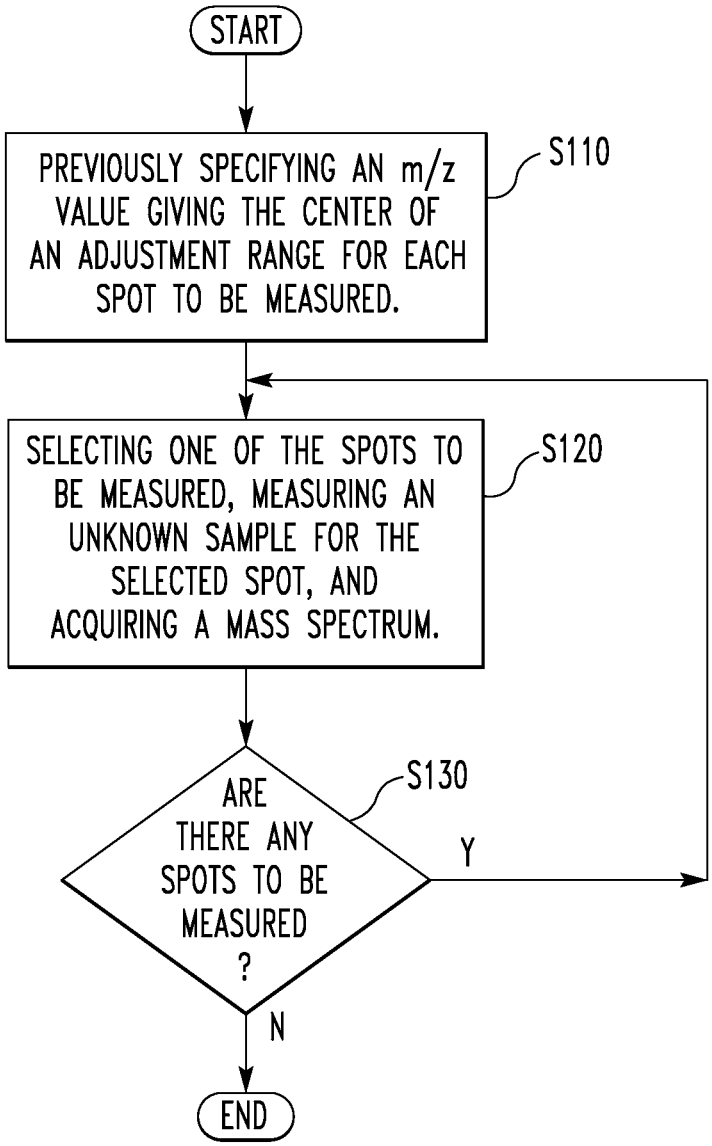
FIG. 14 is a flowchart illustrating one method of mass analyzing an unknown substance in accordance with a fourth embodiment of the invention.

FIG. 14 is a flowchart illustrating one example of method of mass analyzing an unknown sample by the use of the TOF mass spectrometer of the fourth embodiment.

First, the user previously specifies an m/z value giving the center of an adjustment range for each spot to be measured (S110). The parameter adjusting portion 45 correlates the specified m/z value with the spots to be measured and stores the specified m/z in the storage portion 50.

Then, one of the spots to be measured is selected. An unknown sample is measured for the selected spot, and a mass spectrum is acquired (S120). The parameter adjusting portion 45 refers to the storage portion 50, specifies the m/z value stored in step S110 in a manner correlated to the spot, and calculates the adjustment parameters. Then, the parameter setting portion 41 sets the adjustment parameters calculated by the adjusting portion 45. A measurement of an unknown sample is started. In this single measurement, a mass spectrum in which the mass resolution is high at the previously specified m/z value is obtained from the spot to be measured.

If there remains any spot to be measured yet (Y at S130), a new spot to be measured is selected. Step S120 is performed. If there remains no spot to be measured (N at S130), the processing is terminated.

The measurements of all the spots to be measured may be automated. Measurement of each spot may be initiated when a user's instruction is given.

In this way, according to the TOF mass spectrometer of the fourth embodiment, if an m/z value giving the center of an adjustment range is preset for each spot to be measured, it is unnecessary that the user specify the m/z value giving the center of an adjustment range according to the results of a measurement of an unknown sample and that a remeasurement be made. Therefore, successive measurements of plural spots can be automated. In addition, only one measurement is needed for each spot. For example, where a mass range to be measured can be estimated for each spot, automated measurement is enabled by previously specifying an m/z value giving the center of a desired adjustment range for each spot.

For example, in a case where the effluent from a size exclusion chromatograph that is one type of liquid chromatograph is partitioned into aliquots (spots) on the sample plate of the ion source 10 and each spot is measured, the mass range to be measured can be estimated for each spot, because effluent constituents generally leave the chromatograph first from the constituent having the greatest molecular weight. In this case, it is possible to specify an m/z value giving the center of a desired adjustment range for each spot.

5. Fifth Embodiment

The TOF mass spectrometer of the fifth embodiment performs fully automated mass spectrometry measurements of all spots to be measured.

The TOF mass spectrometer of the fifth embodiment is similar in configuration with the spectrometer of the first embodiment shown in FIG. 1 except for the following points.

Figure 15:
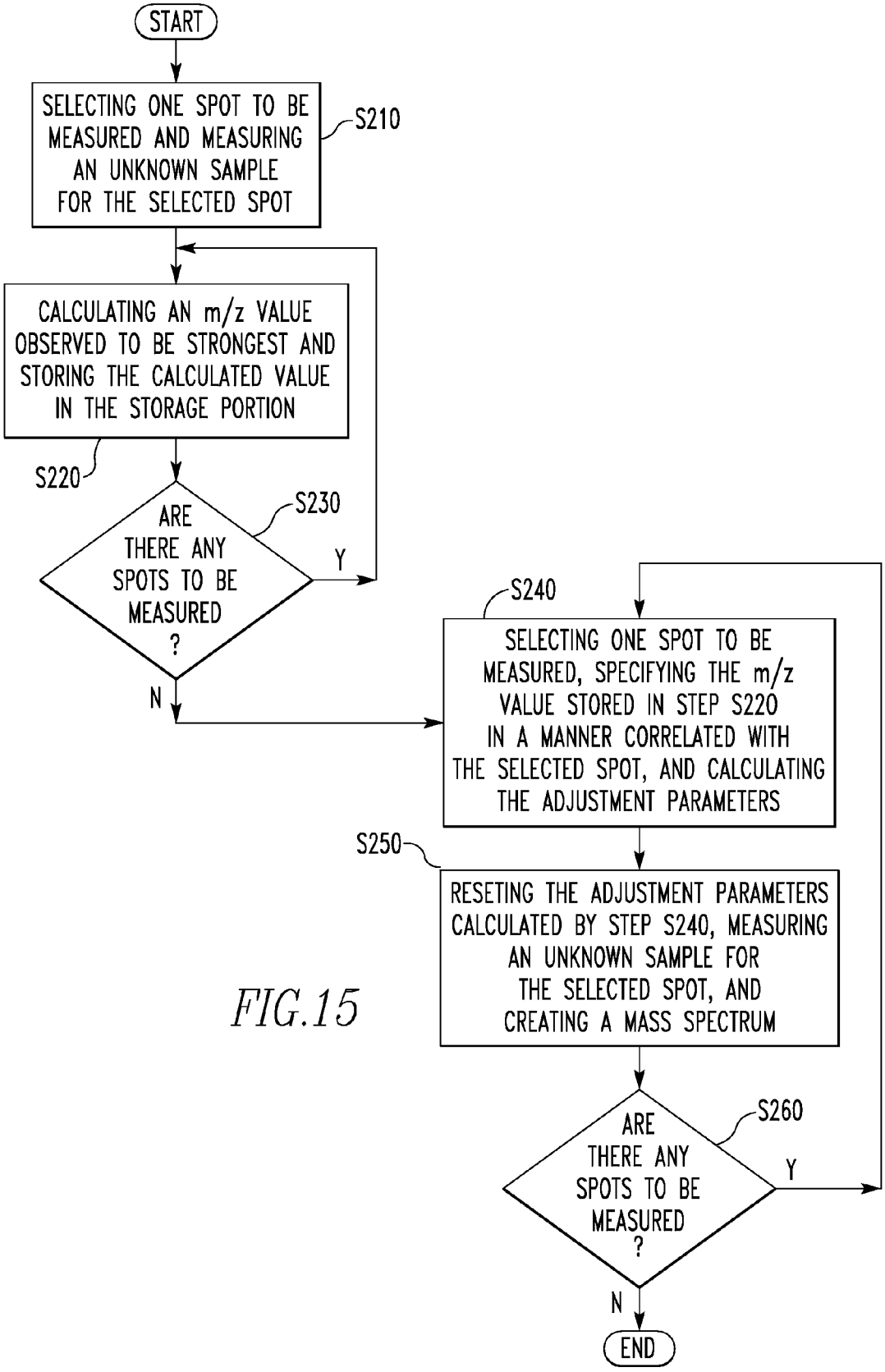
FIG. 15 is a flowchart illustrating one example of processing performed by signal processing electronics in accordance with a fifth embodiment of the invention.
Figure 16A:
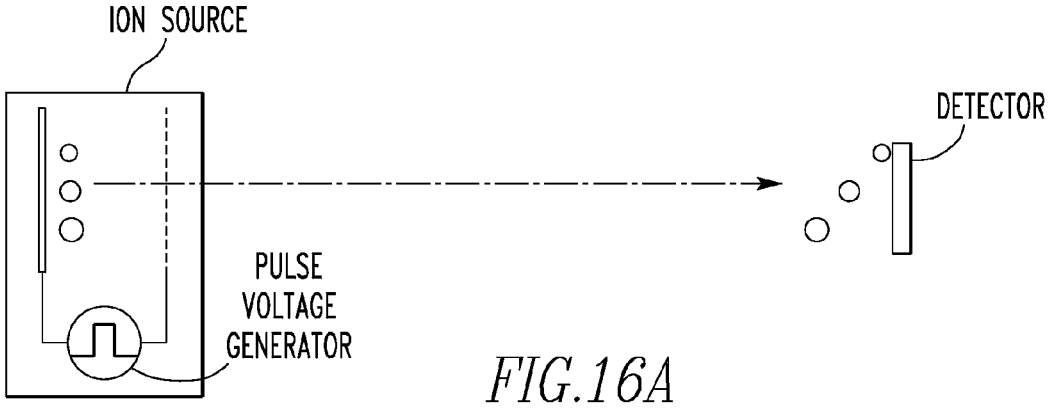
FIG. 16A is a conceptual diagram of a linear TOFMS.
Figure 16B:
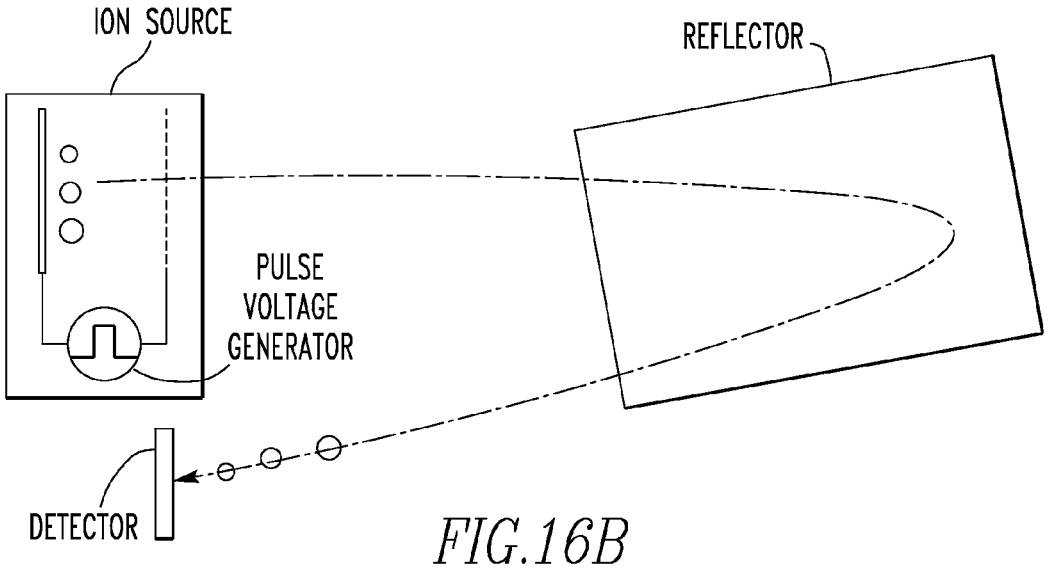
FIG. 16B is a conceptual diagram of a reflectron TOFMS.

FIG. 15 is a flowchart illustrating one example of processing performed by the signal processing electronics 40 of the TOF mass spectrometer of the fifth embodiment.

First, the processing electronics 40 select one spot to be measured and measure an unknown sample for the selected spot (S210).

Then, the signal processing electronics 40 calculate an m/z value observed to be strongest in step S210 and stores the calculated value in the storage portion 50 (S220). In particular, the parameter adjusting portion 45 calculates the m/z value corresponding to the strongest intensity based on the output signal from the detector 30.

If there remains any spot to be measured (Y at S230), the processing electronics 40 select a new spot to be measured and perform steps S210 and S220.

If there remains no spot to be measured (N at S130), the processing electronics 40 select one spot to be measured, specify the m/z value stored in step S220 in a manner correlated with the selected spot, and calculate the adjustment parameters (S240).

Then, the processing electronics 40 reset the adjustment parameters calculated by step S240 into the ion source 10 and into the detector 30, measure an unknown sample for the selected spot, and create a mass spectrum (S250).

If there remains any spot to be measured (Y at S260), the signal processing electronics 40 select a new spot to be measured and perform the steps S240 and S250 until there remains no spot to be measured (N at S260).

In this way, according to the TOF mass spectrometer of the fifth embodiment, a first measurement is performed for each spot to be measured. An adjustment parameter that brings an m/z value corresponding to the strongest intensity into the center of an adjustment range is calculated. A second measurement is performed. Even where a mass range to be measured at each spot cannot be estimated, successive measurements of plural spots can be performed automatically.

It is to be understood that the present invention is not restricted to the embodiments described above and that various changes and modifications are possible within the scope of the invention.

The present invention embraces configurations substantially identical (e.g., in function, method, and results or in purpose and advantageous effects) with the configurations described in the preferred embodiments of the invention. Furthermore, the invention embraces the configurations described in the embodiments including portions which have replaced non-essential portions. In addition, the invention embraces configurations which produce the same advantageous effects as those produced by the configurations described in the preferred embodiments or which can achieve the same objects as the objects of the configurations described in the preferred embodiments. Further, the invention embraces configurations which are the same as the configurations described in the preferred embodiments and to which well-known techniques have been added.

Having thus described my invention with the detail and particularity required by the Patent Laws, what is desired protected by Letters Patent is set forth in the following claims.

The invention claimed is:

1. A time-of-flight mass spectrometer comprising:

an ion source for ionizing a sample by laser irradiation and accelerating generated ions by a delayed extraction method;

a detector for detecting ions arriving at the detector after making a flight from the ion source;

a storage portion holding an adjustment table in which a corresponding relationship between m/z values of known substances and values of given adjustment parameters including delayed extraction parameters associated with the delayed extraction method for the ion source is defined;

a parameter adjusting portion for calculating values of the adjustment parameters correlated with any specified m/z value based on the adjustment table;

a parameter setting portion for setting the delayed extraction parameters of the ion source based on the values of the adjustment parameters calculated by the parameter adjusting portion; and a flight time measuring portion for measuring flight times taken for the ions generated by the ion source, for which the delayed extraction parameters have been set, to reach the detector.

2. A time-of-flight mass spectrometer as set forth in claim 1, wherein said delayed extraction parameters include at least one of a parameter capable of identifying the ratio of a sample plate voltage applied to a sample plate of the ion source to a pulsed voltage applied to accelerating electrodes of the ion source and a parameter capable of identifying timing at which the pulsed voltage is generated.

3. A time-of-flight mass spectrometer as set forth in any one of claims 1 and 2, wherein said parameter adjusting portion calculates values of the adjustment parameters correlated with the specified m/z value by linearly interpolating between the values of the adjustment parameters contained in the adjustment table according to the specified m/z value.

4. A time-of-flight mass spectrometer as set forth in any one of claims 1 and 2, wherein said parameter adjusting portion approximates an expression representing a relationship between the values of the adjustment parameters contained in the adjustment table and the m/z values by a polynomial expression and calculates the values of the adjustment parameters correlated with the specified m/z value using the polynomial expression.

5. A time-of-flight mass spectrometer as set forth in any one of claims 1 and 2, wherein said parameter adjusting portion sets ranges of m/z values in which the values of the adjustment parameters contained in the adjustment table are applied such that the ranges do not overlap with each other and takes the values of the adjustment parameters applied in the range of m/z values including the specified m/z value as values of the adjustment parameters correlated with the specified m/z value.

6. A time-of-flight mass spectrometer as set forth in any one of claims 1 and 2, wherein said adjustment parameters include at least one of an intensity of laser light impinging on the ion source and an output voltage from the detector, and wherein said parameter setting portion sets at least one of the intensity of the laser light and the output voltage from the detector based on the values of the adjustment parameters calculated by the parameter adjusting portion.

7. A time-of-flight mass spectrometer as set forth in any one of claims 1 and 2, wherein there is further provided an m/z calculating portion for converting flight times measured by the flight time measuring portion into m/z values based on a given conversion formula, said adjustment parameters contained in the adjustment table include correction amounts used to correct m/z values, which have been converted from flight times based on the conversion formula, to m/z values of each known substance contained in the adjustment table, said flight times are measured after setting values of the delayed extraction parameters of the known substances into the ion source, the delayed extraction parameters being contained in the adjustment table, and said m/z calculating portion modifies coefficients of the conversion formula based on the correction amounts contained in the adjustment table.

8. A time-of-flight mass spectrometer as set forth in any one of claims 1 and 2, wherein said parameter adjusting portion calculates the values of the adjustment parameters correlated with any previously specified m/z value for each spot disposed on the sample plate of the ion source, the spot undergoing a measurement, and wherein said parameter setting portion sets the delayed extraction parameters based on the values of the adjustment parameters calculated by the parameter adjusting portion for each spot of the ion source to be measured.

9. A time-of-flight mass spectrometer as set forth in any one of claims 1 and 2, wherein said parameter adjusting portion calculates an ink value corresponding to the strongest intensity based on the output signal from the detector, prompts a user to specify one of the calculated m/z values, and calculates the values of the adjustment parameters.

10. A time-of-flight mass spectrometer as set forth in claims 1 and 2, wherein said ion source ionizes the sample by a MALDI technique.

11. A method of time-of-flight mass spectrometry, comprising the steps of:

ionizing a sample by laser irradiation;

calculating values of given adjustment parameters that are correlated with a specified m/z value based on an adjustment table in which a corresponding relationship between m/z values of known substances and values of the aforementioned given adjustment parameters is defined, the given adjustment parameters including delayed extraction parameters associated with a delayed extraction method for the ion source that accelerates generated ions by the delayed extraction method;

setting the delayed extraction parameters of the ion source based on the calculated values of the adjustment parameters; and measuring flight times taken for the ions generated by the ion source, for which the delayed extraction parameters have been set, to reach the detector.

* * * * *

UNITED STATES PATENT AND TRADEMARK OFFICE

CERTIFICATE OF CORRECTION

PATENT NO. : 8,653,451 B2
APPLICATION NO. : 13/477105
DATED : February 18, 2014
INVENTOR(S) : Takaya Satoh It is certified that error appears in the above-identified patent and that said Letters Patent is hereby corrected as shown below:

In the Claims:

Column 18, Line 24, Claim 9, delete “ink” and insert -- m/z --

Signed and Sealed this
Seventeenth Day of June, 2014

Michelle K. Lee

Michelle K. Lee
*Deputy Director of the United States Patent and Trademark Office*